US006172594B1

(12) United States Patent
Goo

(10) Patent No.: US 6,172,594 B1
(45) Date of Patent: Jan. 9, 2001

(54) FOCUS UNIT OF FLY BACK TRANSFORMER

(75) Inventor: Tae Woo Goo, Kyungki-do (KR)

(73) Assignee: Samsung Electro-Mechanics Co., Ltd., Kyungki-do (KR)

( * ) Notice: Under 35 U.S.C. 154(b), the term of this patent shall be extended for 0 days.

(21) Appl. No.: 09/273,071

(22) Filed: Mar. 19, 1999

(51) Int. Cl.[7] ..... H01C 10/16

(52) U.S. Cl. ..... 338/128; 338/162; 338/202; 338/184

(58) Field of Search ..... 338/160, 162, 338/118, 202, 184, 128, 129, 130

(56) References Cited

U.S. PATENT DOCUMENTS 3,631,371 * 12/1971 Maurice ..... 338/164
5,105,128 * 4/1992 Choi ..... 315/382
5,321,385 * 6/1994 Rilling ..... 338/202
5,726,625 * 3/1998 Hasebe et al. ..... 338/162
5,920,252 * 7/1999 Nakagawa ..... 338/160
5,923,241 * 7/1999 Garvalos ..... 338/162

FOREIGN PATENT DOCUMENTS 98-065047 * 10/1998 (KR) .

* cited by examiner

*Primary Examiner*—Karl D. Easthom
(74) *Attorney, Agent, or Firm*—Renner, Otto, Boisselle & Sklar LLP

(57) ABSTRACT

A focus unit of an FBT (fly back transformer) is disclosed. Particularly a focus volume slider of the focus unit is disclosed. A ceramic substrate 150 is installed within and on the bottom of a cover 130 through which an actuation knob 120 passes. A variable contact 172 of a slider 170 contacts with a resistor pattern 140 of the ceramic substrate 150, so that the voltage volume can be controlled. Since the ceramic substrate is disposed separated from an FBT case which accommodates bobbins for generating a high voltage, the insulation of the focus unit by filling and curing an insulating resin is not required, and therefore, the manufacturing process is simplified.

11 Claims, 4 Drawing Sheets

FOCUS UNIT OF FLY BACK TRANSFORMER

BACKGROUND OF THE INVENTION

1. Field of the Invention

The present invention relates to a fly back transformer (to be called "FBT" below) which generates a high voltage to supply it to a TV or a monitor. Particularly, the present invention relates to a focus unit of an FBT, which is installed on a side of the FBT, so that the focus and screen voltages can be adjusted. More specifically, the present invention relates to a focus unit of an FBT, in which the filling and curing of an insulating resin are eliminated. That is, a ceramic substrate with a resistor pattern formed thereon is installed within a cover through which an actuation knob of the focus unit passes. A slider is installed at an end of a volume shaft, and the volume shaft is formed integrally with the actuation knob, while a central contact of the slider contacts to a central terminal which is formed within the case, the case being facingly coupled with the cover. Further, a variable contact of the slider contacts to the resistor pattern of the ceramic substrate, so that a volume control can be carried out. Further, the ceramic substrate which is installed within the focus unit and on which the resistor pattern is printed is installed within the cover of the focus unit, and separated from an FBT case within which bobbins are installed. Therefore, the filling and curing of an insulating resin becomes needless.

2. Description of the Prior Art

In the generally known conventional FBT, the low voltage and high voltages bobbins generate a high voltage, and this high voltage is supplied through an anode cable to a cathode ray tube. Under this condition, the focus unit which is installed on a side of the FBT case varies the focus voltage and the screen voltage through a volume slider.

This conventional focus unit of the FBT is constituted as shown in FIG. 1. That is, a rotating piece 54 is installed within a main body 52 of the focus unit 51, and is connected to a focus and screen adjusting handle 53. On the top of the rotating piece 54, there is installed a slider 55 which has two contact points 56 and 56'. A substrate 58 on which a circuit pattern 57 having variable and central contact points 57*a* and 57*b* is printed is installed in such a manner that the contact points 57*a* and 57*b* are connected to the contacts 56 and 56' of the slider 55. From the substrate 58, there protrudes an output pin 59, and the substrate 58 is insulated by coating an insulating resin 60.

In the conventional focus unit 51 constituted as described above, if the focus and screen voltages are to be varied, the focus and screen adjusting handle 53 is turned. Then the slider 55 is rotated together with the rotating piece 54 to vary the voltages. Under this condition, the slider 55 has two contacts 56 and 56', and one of them (56) is connected to the variable contact 57*a* of the circuit pattern 57 of the substrate 58, thereby stepping up or down the focus and screen voltages. Meanwhile, another (56') of the contacts is connected to the central contact 57*b*, so that an output can be drawn through a resistor.

However, in this conventional focus unit 51, the slider 55 which is installed above the handle 53 has two contacts 56 and 56' for stepping up or down the focus and screen voltages. Further, the circuit pattern 57 of the substrate 58 has variable and central contacts 57*a* and 57*b*, so that these contacts can be made to be connected to the contacts 56 and 56'. Thus the structure is very complicated, and the contacts might not be electrically connected, these being serious disadvantages.

Further, the substrate 58 having the circuit pattern 57 is disposed at the rear side of the focus unit, and therefore, the circuit pattern 57 is disposed near to the bobbins from which the high voltage is drawn. Therefore, the insulating characteristic is very weak. In order to overcome this problem, the substrate 58 is coated with an insulating resin, this being a troublesome task.

SUMMARY OF THE INVENTION

The present invention is intended to overcome the above described disadvantages of the conventional technique.

Therefore it is an object of the present invention to provide a focus unit of an FBT, in which a ceramic substrate with a resistor pattern printed thereon is installed within a cover of the focus unit, so that the ceramic substrate can be separated from a case of bobbins, thereby making it needless to fill an insulating resin into the focus unit and to cure the resin.

In achieving the above object, the focus unit of an FBT according to the present invention includes: a focus unit cover having two through holes for passing volume shafts of actuation knobs; each of the volume shafts being formed integrally with the actuation knob, and passing through each of the through holes; a substrate installed on an inside of the focus unit cover, and having a resistor pattern on an upper face of the substrate; a slider installed on an upper end of the volume shaft, and having a central contact and a variable contact for adjusting a voltage volume by contacting with the resistor pattern of the substrate; and a case facing toward the cover, and having a central terminal so as to contact with the central contact of the slider.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
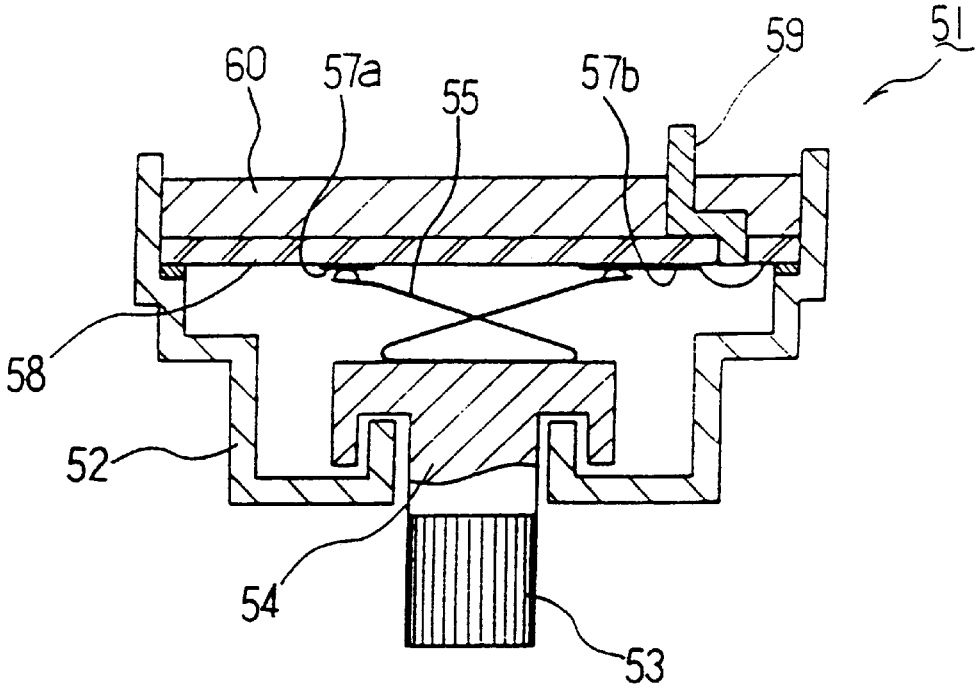
FIG.1 Prior Art
FIG. 1 illustrates the internal structure of the conventional focus unit to show the structure of the general FBT focus volume slider.
Figure 2:
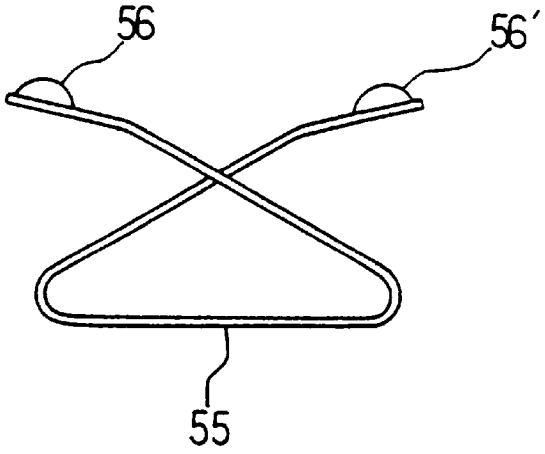
FIG.2 Prior Art
FIG. 2 illustrates the structure of the volume slider for the conventional focus unit.
Figure 3:
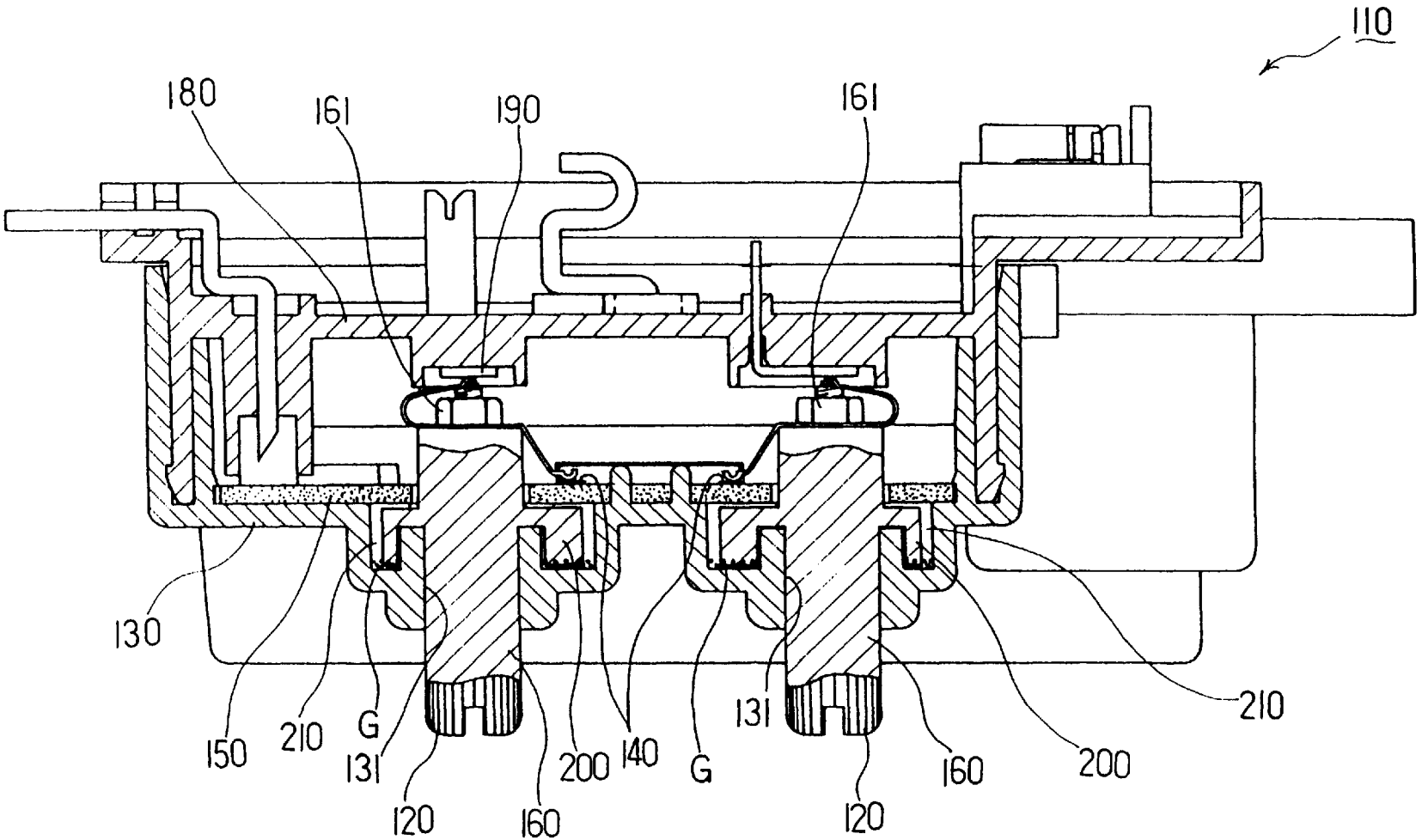
FIG. 3 illustrates the internal structure of the focus unit and the focus volume slider according to the present invention.
Figure 4:
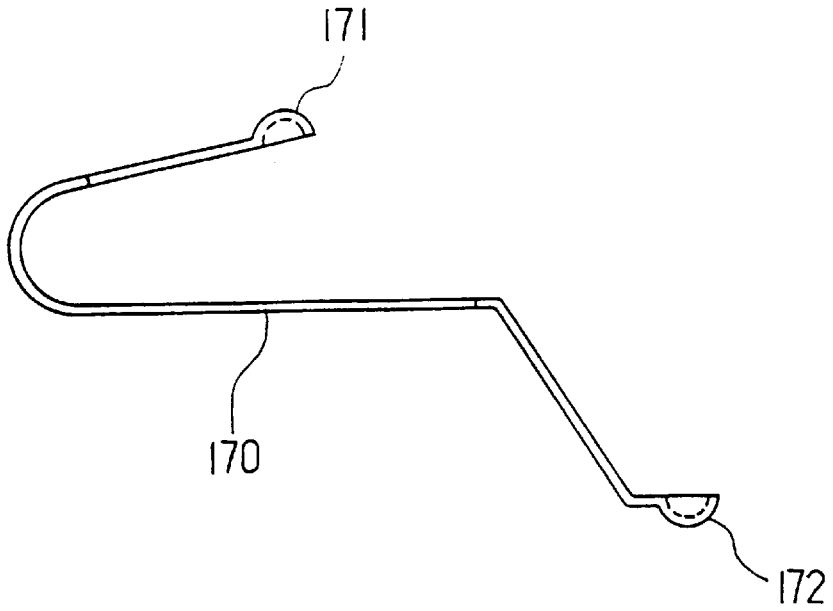
FIG. 4 illustrates a side view showing the structure of the slider according to the present invention.
Figure 5:
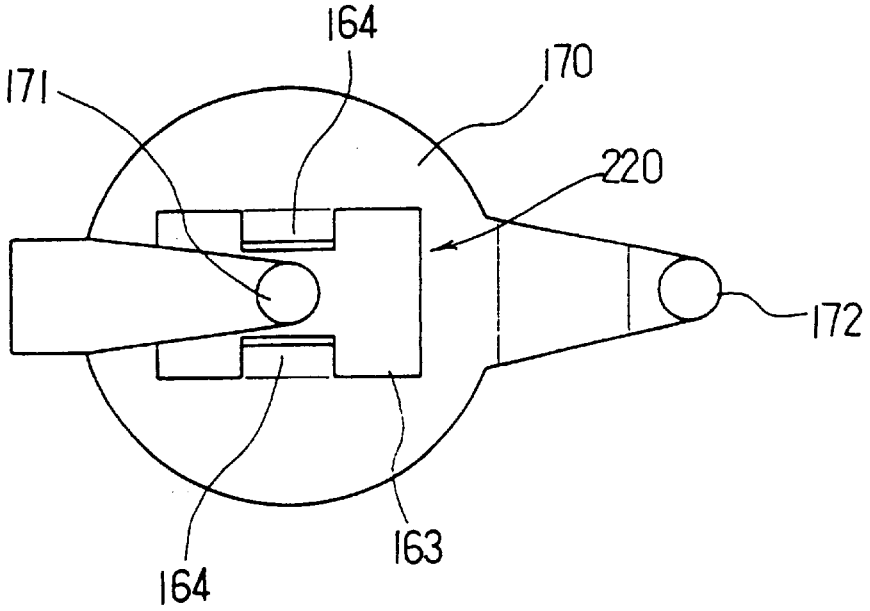
FIG. 5 is a plan view showing the slider according to the present invention.
Figure 6:
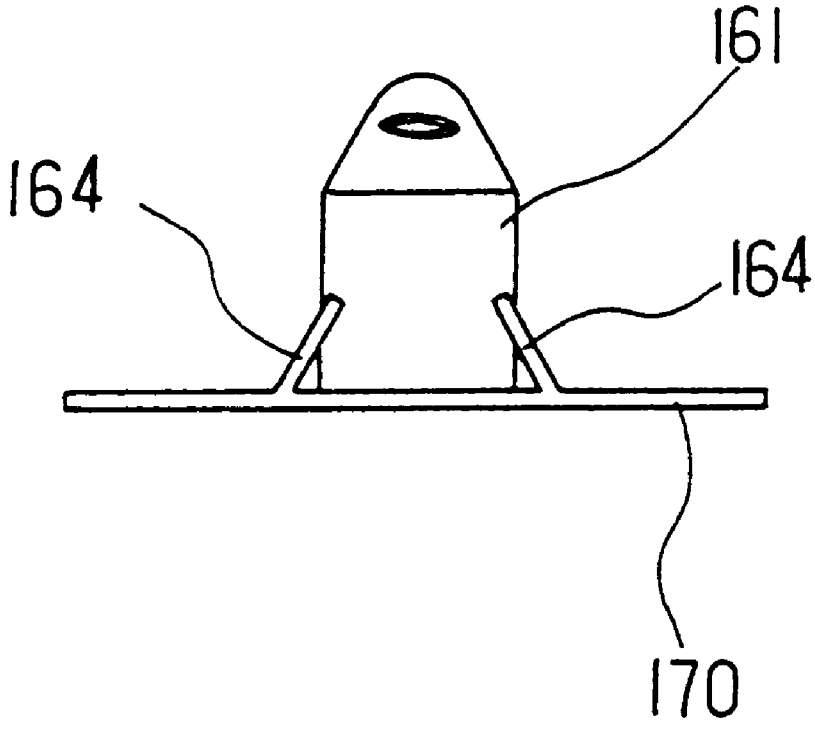
FIG. 6 illustrates a critical portion showing the stepped portion of the volume shaft and the slider of the present invention coupled together.

FIG. 3 illustrates the internal structure of the focus unit and the focus volume slider according to the present invention. FIG. 4 illustrates a side view showing the structure of the slider according to the present invention.

The focus unit 110 has a cover 130 having two through holes 131 through which actuation knobs 120 pass to protrude to the outside. Each of volume shafts 160 is formed integrally with the actuation knob 120, and passes through the through hole 131 of the cover 130. On the inside bottom of the cover 130, there is disposed a substrate 150 on which a resistor pattern 140 is formed.

A slider 170 is installed on the upper end of the volume shaft 160, and the slider 170 has a central contact 171, while the slider 170 has a variable contact 172 on the opposite end thereof. The variable contact 172 contacts with the resistor pattern 140 of the substrate 150 to adjust the voltage volume.

Under this condition, the central contact 171 of the slider 170 contacts with a central terminal 190 which is installed within a case 180. The cover 130 and the case 180 are mutually facingly coupled together, and the contact between the central contact 171 and the central terminal 190 causes a variable voltage to be outputted.

An annular slider supporting piece 200 projects from the volume shaft 160 to be inserted into an annular guide groove 210 so as to be rotated.

Further, the slider 170 which is coupled to the upper end of the volume shaft 160 has a coupling part 220, and at the center of the slider 170, there is formed a rectangular coupling hole 163 for receiving a stepped portion 161 of the volume shaft 160. From the opposite edges of the rectangular coupling hole 163, there protrude two elastic coupling pieces 164 in an inclined form to elastically secure the stepped portion 161 of the volume shaft 160.

Now the present invention constituted as above will be described as to its action and effects.

As shown in FIGS. 3 to 6, in the focus unit 110, there is installed the ceramic substrate 150 on which the resistor pattern 140 is formed. The ceramic substrate 150 is installed on the inside bottom of the cover 130 through which the actuation knobs 120 pass. The slider 170 contacts with the upper tip of the volume shaft 160 which is integrally formed with the actuation knob 120.

Thus the focus voltage and the screen voltage can be stepped up or down by rotating the actuation knobs 120. Under this condition, the central contact 171 of the slider 170 contacts with the central terminal 190 which is formed within the case 180 which is coupled with the cover 130. The variable contact 172 of the slider 170 can be rotated in contact with the resistor pattern 140 of the ceramic substrate 150, thereby making it possible to control the focus and screen voltages.

When the voltage volume is adjusted through the volume shaft 160 and the slider 170, the variable contact 172 of the slider 170 contacts with the resistor pattern 140 of the ceramic substrate 150 as shown in FIG. 3. Thus the ceramic substrate 150 is separated from an FBT case where bobbins are accommodated to generate a high voltage. Therefore, the ceramic substrate 150 can be insulated even without filling an insulating resin and curing it, so that the focus and screen voltages can be controlled through the slider 170 in a sure manner.

Meanwhile, the volume shaft 160 is coupled with the slider 170 in the following manner. That is, the stepped portion 161 of the volume shaft 160 is inserted into the coupling hole 163 of the slider 170. Further, two elastic coupling pieces 164 protrude from opposite edges of the rectangular coupling hole 163 in an inclined form, so that the stepped portion 161 of the volume shaft 160 can be elastically secured.

That is, the stepped portion 161 having a rectangular cross section is slightly tightly inserted into the rectangular coupling hole 163. Thus the two elastic coupling pieces 164 are spread, and when the stepped portion 161 has been inserted to the final depth, the two coupling pieces 164 tightly grip the stepped portion 161. Therefore, the stepped portion 161 will not depart from the rectangular coupling hole 163.

Further, in order to give a sufficient torque to the slider 170, the volume shaft 160 which is integrally formed with the actuation knob 120 is provided with a slider supporting piece 200 integrally with the volume shaft 160. The radially outer portion of the annular slider supporting piece 200 is vertically bent down to be inserted into the annular guide groove 210 of the cover 130. The torque of the slider 170 is adjusted by the slider supporting piece 200. Grease is spread within the guide groove 210 of the cover 130, so that the slider supporting piece 200 can be smoothly rotated.

According to the present invention as described above, the ceramic substrate of the focus unit is installed within the cover of the focus unit, and therefore, the substrate is separated from the FBT case in which bobbins are installed. Therefore, even without filling and curing an insulating resin into the inside of the focus unit, the ceramic substrate can be effectively insulated. Therefore, the focus voltage and the screen voltage can be controlled in a sure manner, and the focus unit can be manufactured in an easy manner.

In the above, the present invention was described specifically based on the attached drawings, but it should be apparent to those ordinarily skilled in the art that various changes and modifications can be added without departing from the scope of the present invention which is defined in the appended claims.

What is claimed is:

1. A focus unit for an FBT, comprising:

a focus unit cover having two through holes;

a pair of actuation knobs protruding from the cover, the actuation knobs having integrally formed therewith respective shafts having respective central axes and extending through the holes in the focus unit cover;

a substrate having a resistor pattern on an upper face thereof, the substrate being located inside the focus unit cover and having holes through which the shafts extend; and a slider attached to an upper end of each shaft, the slider having a variable contact in contact with the resistor pattern on the substrate and a central contact in contact with a central terminal with respect to said respective central axes disposed at a position opposite the cover.

2. The focus unit as claimed in claim 1, wherein each variable contact is bent toward the substrate.

3. The focus unit as claimed in claim 1, wherein each central terminal is supported in a case coupled to an upper end of the cover.

4. The focus unit as claimed in claim 1, wherein each shaft has a stepped portion at its upper end, and each slider has a rectangular coupling hole at its center in which the stepped portion of the respective shaft is received.

5. The focus unit as claimed in claim 4, wherein each slider includes two elastic coupling pieces extending at an incline from opposite edges of the rectangular coupling hole for engaging the stepped portion of the shaft.

6. A focus unit for an FBT, comprising:

a focus unit cover having at least one through hole;

an actuation knob protruding from the cover, the actuation knob having integrally formed therewith a shaft having a central axis and extending through the hole in the focus unit cover;

a substrate having a resistor pattern on an upper face thereof, the substrate being located inside the focus unit cover and having a holes through which the shaft extends; and a slider attached to an upper end of the shaft, the slider having a variable contact in contact with the resistor pattern on the substrate and a central contact in contact with a central terminal with respect to the central axis disposed at a position opposite the cover.

7. The focus unit as claimed in claim 6, wherein the variable contact is bent toward the substrate.

8. The focus unit as claimed in claim 6, wherein the central terminal is supported in a case coupled to an upper end of the cover.

9. The focus unit as claimed in claim 6, wherein the shaft has a stepped portion at its upper end, and the slider has a rectangular coupling hole at its center in which the stepped portion of the shaft is received.

10. The focus unit as claimed in claim 9, wherein the slider includes at least one elastic coupling piece extending at an incline from an edge of the rectangular coupling hole for engaging the stepped portion of the shaft.

11. A focus unit for an FBT, comprising:

a case;

a focus unit cover attached to said case and having at least one through hole;

an actuation knob protruding from the cover, the actuation knob having integrally formed therewith a shaft having a central axis and extending through the hole in the focus unit cover;

a substrate having a resistor pattern on an upper face thereof, the substrate being located inside the focus unit cover and having a hole through which the shaft extends; and a slider attached to an upper end of the shaft, the slider having a variable contact in contact with the resistor pattern on the substrate and a central contact in contact with a central terminal with respect to said central axis disposed in said case at a position opposite the cover.

* * * * *